US009444130B2

(12) United States Patent
Bevelacqua et al.

(10) Patent No.: US 9,444,130 B2
(45) Date of Patent: Sep. 13, 2016

(54) ANTENNA SYSTEM WITH RETURN PATH TUNING AND LOOP ELEMENT

(71) Applicant: Apple Inc., Cupertino, CA (US)

(72) Inventors: Peter Bevelacqua, San Jose, CA (US); Hao Xu, Cupertino, CA (US); Jayesh Nath, Milpitas, CA (US); Jennifer M. Edwards, San Francisco, CA (US); Mattia Pascolini, Campbell, CA (US)

(73) Assignee: Apple Inc., Cupertino, CA (US)

( * ) Notice: Subject to any disclaimer, the term of this patent is extended or adjusted under 35 U.S.C. 154(b) by 483 days.

(21) Appl. No.: 13/860,396

(22) Filed: Apr. 10, 2013

(65) Prior Publication Data

US 2014/0306857 A1 Oct. 16, 2014

(51) Int. Cl.

| | |
|---|---|
| ***H01Q 1/24*** | (2006.01) |
| ***H01Q 7/00*** | (2006.01) |
| ***H01Q 9/04*** | (2006.01) |

(52) U.S. Cl.

CPC ..... *H01Q 1/243* (2013.01); *H01Q 7/00* (2013.01); *H01Q 9/0442* (2013.01)

(58) Field of Classification Search

CPC ..... H01Q 1/243; H01Q 7/00; H01Q 9/0442
USPC ..... 343/702, 700 MS, 866, 750
See application file for complete search history.

(56) References Cited

U.S. PATENT DOCUMENTS

| | | | | |
|---|---|---|---|---|
| 4,518,965 A | | 5/1985 | Hidaka | |
| 5,048,118 A | | 9/1991 | Brooks et al. | |
| 5,768,691 A | | 6/1998 | Kangas et al. | |
| 5,832,372 A | | 11/1998 | Clelland et al. | |
| 5,926,139 A | * | 7/1999 | Korisch | H01Q 1/243 343/700 MS |
| 6,034,636 A | | 3/2000 | Saitoh | |

(Continued)

FOREIGN PATENT DOCUMENTS

| | | |
|---|---|---|
| CN | 102110873 | 6/2011 |
| CN | 102683861 | 9/2012 |

(Continued)

OTHER PUBLICATIONS

Bevelacqua et al., U.S. Appl. No. 13/860,396, filed Apr. 10, 2013.

(Continued)

*Primary Examiner* — Dieu H Duong
(74) *Attorney, Agent, or Firm* — Treyz Law Group, P.C.; G. Victor Treyz; Michael H. Lyons

(57) ABSTRACT

Electronic devices may include radio-frequency transceiver circuitry and antenna structures. The antenna structures may include a dual arm inverted-F antenna resonating element and an antenna ground. An antenna feed may be coupled between the inverted-F antenna resonating element and the antenna ground. An adjustable component such as an adjustable inductor may be coupled between the inverted-F antenna resonating element and the antenna ground in parallel with the antenna feed. The adjustable component may be operable in multiple states such as an open circuit state, a short circuit state, and a state in which the adjustable component exhibits a non-zero inductance. Antenna bandwidth can be broadened by coupling a loop antenna resonating element across the antenna feed. A portion of the antenna ground may overlap the loop antenna resonating element to further enhance antenna bandwidth.

16 Claims, 8 Drawing Sheets

(56) References Cited

U.S. PATENT DOCUMENTS 6,218,997 B1 4/2001 Lindenmeier et al.
6,255,994 B1 * 7/2001 Saito ..... H01Q 1/38 343/700 MS
6,317,094 B1 11/2001 Wu et al.
6,414,641 B1 7/2002 Carlson et al.
6,423,915 B1 7/2002 Winter
6,498,586 B2 12/2002 Pankinaho
6,504,507 B2 1/2003 Geeraert
6,529,749 B1 3/2003 Hayes et al.
6,560,443 B1 5/2003 Vaisanen et al.
6,650,295 B2 11/2003 Ollikainen et al.
6,662,028 B1 12/2003 Hayes et al.
6,670,923 B1 12/2003 Kadambi et al.
6,714,162 B1 3/2004 Kadambi et al.
6,734,825 B1 5/2004 Guo et al.
6,762,723 B2 7/2004 Nallo et al.
6,762,729 B2 7/2004 Egashira
6,836,249 B2 12/2004 Kenoun et al.
6,917,335 B2 7/2005 Kadambi et al.
6,922,172 B2 7/2005 Oshiyama et al.
6,933,893 B2 8/2005 Rubinshteyn et al.
6,950,065 B2 9/2005 Ying et al.
6,950,069 B2 9/2005 Gaucher et al.
6,970,137 B1 11/2005 Maslovski et al.
6,980,154 B2 12/2005 Vance et al.
7,043,285 B2 5/2006 Boyle
7,075,493 B2 7/2006 Azadegan et al.
7,079,079 B2 7/2006 Jo et al.
7,145,513 B1 12/2006 Cohen
7,164,387 B2 1/2007 Sievenpiper
7,183,982 B2 2/2007 Kadambi et al.
7,215,283 B2 5/2007 Boyle
7,250,910 B2 7/2007 Yoshikawa et al.
7,260,424 B2 8/2007 Schmidt
7,265,720 B1 9/2007 Ponce De Leon
7,298,340 B2 11/2007 Ohba
7,345,634 B2 3/2008 Ozkar et al.
7,405,701 B2 7/2008 Ozkar
7,408,515 B2 8/2008 Leisten
7,439,911 B2 10/2008 Wang
7,551,142 B1 6/2009 Zhang et al.
7,595,759 B2 9/2009 Schlub et al.
7,612,725 B2 11/2009 Hill et al.
7,626,551 B2 12/2009 Chien et al.
7,671,804 B2 3/2010 Zhang et al.
7,692,595 B2 4/2010 Kim
7,733,271 B2 6/2010 Moon et al.
7,768,462 B2 8/2010 Zhang et al.
7,808,438 B2 10/2010 Schlub et al.
7,812,774 B2 10/2010 Friman et al.
7,843,396 B2 11/2010 Hill et al.
7,876,274 B2 1/2011 Hobson et al.
7,889,143 B2 2/2011 Milosavljevic et al.
7,893,883 B2 2/2011 Schlub et al.
7,898,485 B2 3/2011 Schlub et al.
7,924,226 B2 4/2011 Soler Castany et al.
7,924,231 B2 4/2011 Hill et al.
8,063,827 B2 11/2011 Hotta et al.
8,094,079 B2 1/2012 Schlub et al.
8,111,640 B2 2/2012 Knox
8,270,914 B2 9/2012 Pascolini et al.
8,350,761 B2 1/2013 Hill et al.
8,432,322 B2 4/2013 Amm et al.
8,466,839 B2 6/2013 Schlub et al.
8,577,289 B2 11/2013 Schlub et al.
8,599,089 B2 12/2013 Bevelacqua et al.
8,610,629 B2 12/2013 Pascolini et al.
8,773,310 B2 7/2014 Shiu et al.
8,798,554 B2 8/2014 Darnell et al.
8,855,724 B2 10/2014 Bahramzy
8,872,706 B2 10/2014 Caballero et al.
8,896,488 B2 11/2014 Ayala Vazquez et al.
8,947,302 B2 2/2015 Caballero et al.
8,952,860 B2 2/2015 Li et al.
8,963,782 B2 2/2015 Ayala Vazquez et al.
8,963,784 B2 2/2015 Zhu et al.
9,024,823 B2 5/2015 Bevelacqua
9,070,969 B2 6/2015 Mow et al.
9,166,279 B2 10/2015 Jin et al.
9,166,634 B2 10/2015 Darnell et al.
2003/0098812 A1 5/2003 Ying et al.
2003/0122721 A1 7/2003 Sievenpiper
2003/0189522 A1 10/2003 Zeilinger
2003/0222823 A1 12/2003 Flint et al.
2004/0090377 A1 * 5/2004 Dai ..... H01Q 1/22 343/700 MS
2004/0113845 A1 6/2004 Mikkola
2004/0140933 A1 7/2004 Shikata et al.
2004/0222926 A1 11/2004 Kontogeorgakis et al.
2004/0227674 A1 11/2004 Asano et al.
2004/0227678 A1 11/2004 Sievenpiper
2004/0257283 A1 * 12/2004 Asano ..... H01Q 1/243 343/702
2005/0007291 A1 1/2005 Fabrega-Sanchez et al.
2005/0151689 A1 7/2005 Vesterinen
2005/0270242 A1 12/2005 Qi et al.
2005/0280587 A1 12/2005 Svigelj et al.
2006/0055606 A1 3/2006 Boyle
2006/0097918 A1 5/2006 Oshiyama
2006/0178116 A1 8/2006 Qi et al.
2007/0008222 A1 * 1/2007 Wang ..... H01Q 1/243 343/700 MS
2007/0222697 A1 9/2007 Caimi et al.
2008/0055164 A1 3/2008 Zhang et al.
2008/0150815 A1 6/2008 Nakahata et al.
2008/0165065 A1 7/2008 Hill et al.
2008/0218291 A1 9/2008 Zhu
2008/0238794 A1 10/2008 Pan et al.
2008/0266190 A1 10/2008 Ohba
2008/0278379 A1 11/2008 Wang et al.
2008/0316115 A1 12/2008 Hill et al.
2009/0051604 A1 2/2009 Zhang et al.
2009/0051611 A1 2/2009 Shamblin et al.
2009/0128428 A1 5/2009 Ishizuka et al.
2009/0180403 A1 7/2009 Tudosoiu
2009/0231215 A1 9/2009 Taura
2009/0322639 A1 12/2009 Lai
2010/0053002 A1 3/2010 Wojack et al.
2010/0085260 A1 4/2010 McKinzie et al.
2010/0214180 A1 8/2010 Krogerus
2010/0231470 A1 9/2010 Lee et al.
2010/0238079 A1 9/2010 Aystollahi et al.
2010/0253538 A1 10/2010 Smith
2010/0279734 A1 11/2010 Karkinen et al.
2010/0295737 A1 11/2010 Milosavljevic et al.
2011/0012794 A1 1/2011 Schlub et al.
2011/0021139 A1 1/2011 Montgomery et al.
2011/0102290 A1 5/2011 Milosavljevic
2011/0133995 A1 6/2011 Pascolini et al.
2011/0183721 A1 7/2011 Hill et al.
2011/0188552 A1 8/2011 Yoon et al.
2011/0193754 A1 8/2011 Schlub et al.
2011/0241949 A1 10/2011 Nickel et al.
2011/0250928 A1 10/2011 Schlub et al.
2011/0312393 A1 12/2011 Pulimi et al.
2011/0316751 A1 12/2011 Jarvis et al.
2012/0009983 A1 1/2012 Mow et al.
2012/0046002 A1 2/2012 Hill
2012/0112969 A1 5/2012 Caballero et al.
2012/0112970 A1 5/2012 Caballero et al.
2012/0119955 A1 5/2012 Milosavljevic et al.
2012/0146865 A1 6/2012 Hayashi
2012/0157175 A1 6/2012 Golko
2012/0169552 A1 7/2012 Lee et al.
2012/0176292 A1 7/2012 Hung et al.
2012/0229347 A1 9/2012 Jin
2012/0231750 A1 9/2012 Jin et al.
2012/0299785 A1 11/2012 Bevelacqua
2013/0009828 A1 1/2013 Pascolini et al.
2013/0027254 A1 1/2013 Korva et al.
2013/0033413 A1 2/2013 Du et al.
2013/0050046 A1 2/2013 Jarvis et al.
2013/0102357 A1 4/2013 Vance
2013/0241800 A1 9/2013 Schlub et al.

(56) References Cited

U.S. PATENT DOCUMENTS

| | | | |
|---|---|---|---|
| 2013/0257661 | A1 | 10/2013 | Yuasa et al. |
| 2014/0062815 | A1 | 3/2014 | Tsai et al. |
| 2014/0253392 | A1 | 9/2014 | Yarga et al. |
| 2014/0266941 | A1 | 9/2014 | Vazquez et al. |
| 2014/0292587 | A1 | 10/2014 | Yarga |
| 2014/0313087 | A1 | 10/2014 | Jiang et al. |
| 2014/0340265 | A1 | 11/2014 | Vazquez et al. |
| 2015/0061952 | A1 | 3/2015 | Chiang et al. |

FOREIGN PATENT DOCUMENTS

| | | |
|---|---|---|
| CN | 102684722 | 9/2012 |
| EP | 0892459 | 1/1999 |
| EP | 1146590 | 10/2001 |
| EP | 1168496 | 1/2002 |
| EP | 1363360 | 11/2003 |
| EP | 1387435 | 2/2004 |
| EP | 1501154 | 4/2007 |
| EP | 2178167 | 4/2010 |
| EP | 2182577 | 5/2010 |
| EP | 2234207 | 9/2010 |
| EP | 2328233 | 1/2011 |
| EP | 2405534 | 1/2012 |
| EP | 2528165 | 11/2012 |
| JP | 09093029 | 4/1997 |
| JP | 2000332530 | 11/2000 |
| JP | 2005159813 | 6/2005 |
| JP | 2005167730 | 6/2005 |
| WO | 0003453 | 1/2000 |
| WO | 01/29927 | 4/2001 |
| WO | 0199230 | 12/2001 |
| WO | 02054534 | 7/2002 |
| WO | 02078124 | 10/2002 |
| WO | 2006114771 | 11/2006 |
| WO | 2007012697 | 2/2007 |
| WO | 2011050845 | 5/2011 |
| WO | 2011158057 | 12/2011 |
| WO | 2013010145 | 1/2013 |

OTHER PUBLICATIONS

Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Darnell et al., U.S. Appl. No. 13/368,855, filed Feb. 8, 2012.
Hu et al., U.S. Appl. No. 13/366,142, filed Feb. 3, 2012.
Pascolini et al., U.S. Appl. No. 13/343,657, filed Jan. 4, 2012.
Darnell et al., U.S. Appl. No. 13/435,351, filed Mar. 30, 2012.
"Patch or Strip Loaded Antennas", IP.com Electronic Publication, Sep. 3, 2008.

* cited by examiner

| LT | FREQUENCY COVERAGE |
|---|---|
| 0Ω | 1710-2170 MHz |
| OFF | 700-790 MHz |
| 24nH | 790-960 MHz |

FIG. 4

| LT | FREQUENCY COVERAGE |
|---|---|
| 0Ω | 1710-2690 MHz |
| 24nH | 790-960 MHz |

FIG. 7

ANTENNA SYSTEM WITH RETURN PATH TUNING AND LOOP ELEMENT

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may include radio-frequency transceiver circuitry and antenna structures. The radio-frequency transceiver circuitry may operate in multiple communications bands. The radio-frequency transceiver circuitry may, for example, operate in multiple cellular telephone bands.

The antenna structures may include a dual arm inverted-F antenna resonating element and an antenna ground. An antenna feed may be coupled between the inverted-F antenna resonating element and the antenna ground. An adjustable component such as an adjustable inductor may be coupled between the inverted-F antenna resonating element and the antenna ground to form an adjustable return path in parallel with the antenna feed.

The adjustable component may be operable in multiple states such as an open circuit state, a short circuit state, and a state in which the adjustable component exhibits a non-zero inductance. The adjustable component may also be operable in a pair of states such as a short circuit state and a non-zero inductance state. Control circuitry in the electronic device may be used to place the adjustable component in a suitable state for operating the antenna structures in a desired frequency range.

Antenna bandwidth can be broadened by coupling a loop antenna resonating element across the antenna feed. The loop antenna resonating element may contribute to the resonance of the antenna in a high frequency communications band. A portion of the antenna ground may overlap the loop antenna resonating element to further enhance antenna bandwidth. Adjustments to the adjustable component may be used to tune a low frequency band and may be used to ensure that the antenna operates efficiently in the high frequency band.

Further features of the invention, its nature and various advantages will be more apparent from the accompanying drawings and the following detailed description of the preferred embodiments.

BRIEF DESCRIPTION OF THE DRAWINGS

FIG. 4 is a table showing illustrative settings for a tunable component such as an adjustable inductor that may be used when configuring an antenna in an electronic device to cover various different communications bands of interest in accordance with an embodiment of the present invention.

FIG. 7 is a table showing illustrative settings for a tunable component such as an adjustable inductor that may be used when configuring an antenna in an electronic device to cover high and low communications bands in accordance with an embodiment of the present invention.

DETAILED DESCRIPTION

Figure 1:
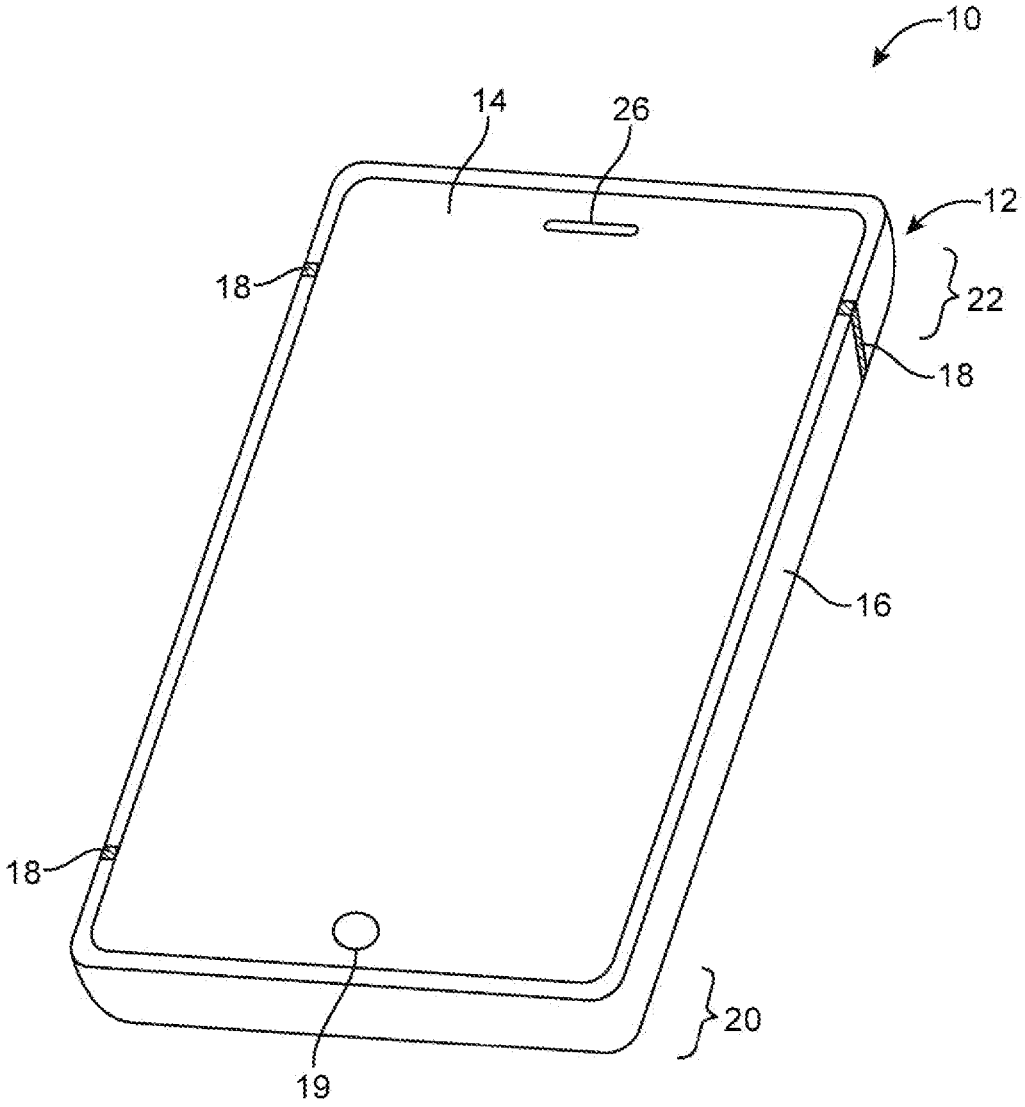
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 19 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
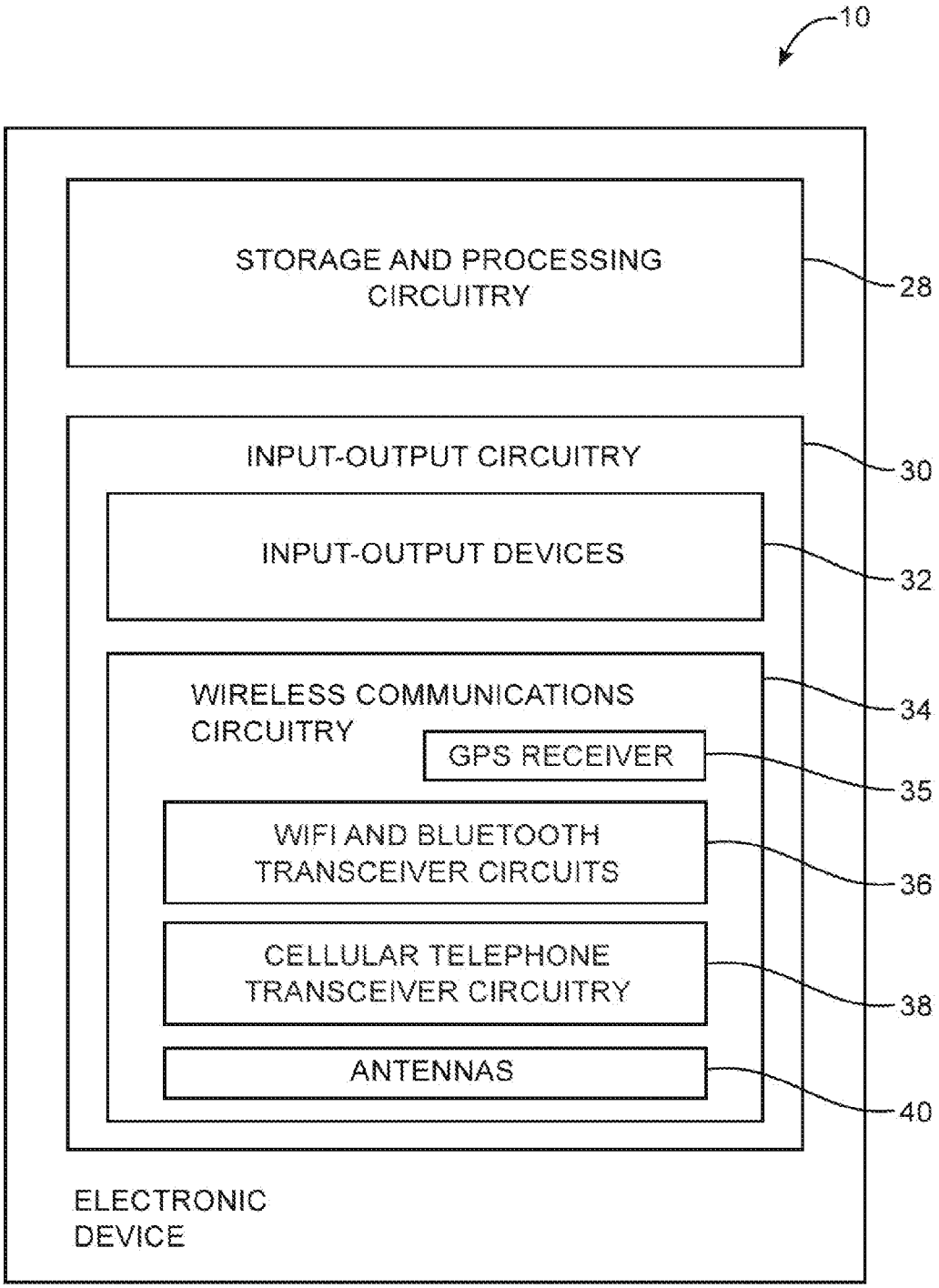
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc.

In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, filters, duplexers, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may have antenna structures such as one or more antennas 40. Antenna structures 40 may be formed using any suitable antenna types. For example, antenna structures 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
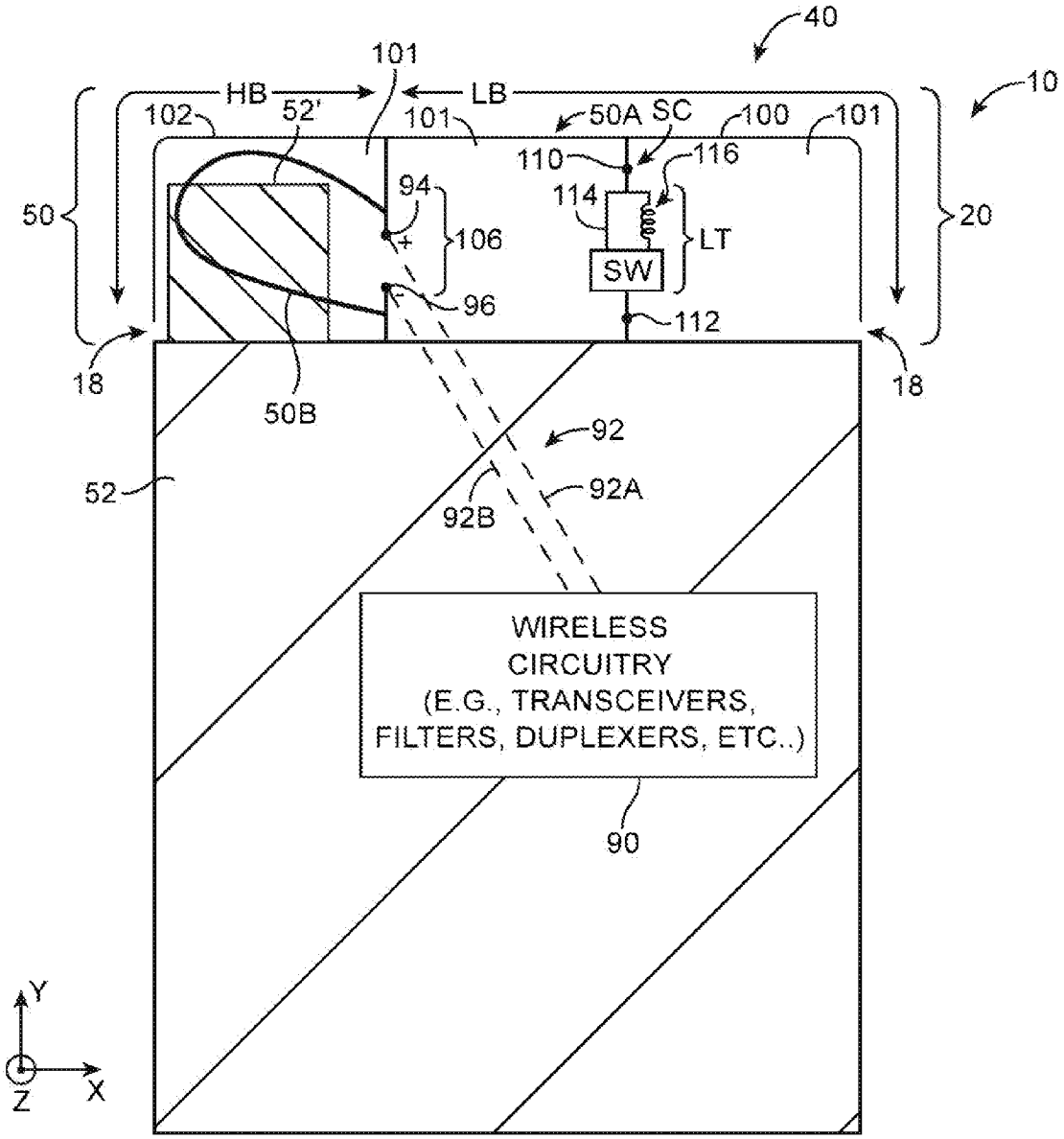
FIG. 3 is a diagram of an illustrative electronic device with an adjustable antenna in accordance with an embodiment of the present invention.

Illustrative antenna structures of the type that may be used in device 10 (e.g., in region 20 and/or region 22) are shown in FIG. 3. Antenna structures 40 of FIG. 3 may be located at lower end 20 of device 10 or other suitable portions of device 10 (e.g., upper end 22). Antenna structures 40 may include antenna ground 52 and may include antenna resonating element structures 50. Antenna resonating element structures 50 may include an antenna resonating element such as antenna resonating element 50A. Antenna resonating element 50A may be a dual arm inverted-F antenna resonating element (sometimes referred to as a T antenna resonating element). Antenna resonating element structures 50 may also include an antenna resonating element such as loop antenna resonating element 50B. Antenna resonating element structures 50 may use structures such as inverted-F antenna resonating element 50A and loop antenna resonating element 50B to form an antenna that covers communications bands of interest.

The conductive structures that form antenna resonating element structures 50A and 50B and antenna ground 52 may be formed from parts of conductive housing structures, from parts of electrical device components in device 10, from printed circuit board traces, from strips of conductor such as strips of wire and metal foil, or may be formed using other conductive structures.

Both resonating element 50A and resonating element 50B may contribute to the overall response of antenna 40. Antenna 40 may therefore sometimes be referred to as being a hybrid antenna that includes both loop antenna and inverted-F antenna structures. If desired, antenna 40 can be based on other types of antenna (e.g., a monopole antenna, a patch antenna, a slot antenna, or other suitable antenna structures). The configuration of FIG. 3 in which antenna 40 has an inverted-F resonating element and a loop resonating element is merely illustrative.

As shown in FIG. 3, antenna structures 40 may be coupled to wireless circuitry 90 such as transceiver circuitry, filters, switches, duplexers, impedance matching circuitry, and other circuitry using transmission line structures such as transmission line 92. Transmission line 92 may have positive signal path 92A and ground signal path 92B. Paths 92A and 92B may be formed from metal traces on rigid printed circuit boards, may be formed from metal traces on flexible printed circuits, may be formed on dielectric support structures such as plastic, glass, and ceramic members, may be formed as part of a cable, or may be formed from other conductive signal lines. Transmission line 92 may be formed using one or more microstrip transmission lines, stripline transmission lines, edge coupled microstrip transmission lines, edge coupled stripline transmission lines, coaxial cables, or other suitable transmission line structures. Circuits such as impedance mating circuits, filters, switches, duplexers, diplexers, and other circuitry may, if desired, be interposed in transmission line 92.

Transmission line 92 may be coupled to an antenna port for antenna 40. Antenna port 106, which may sometimes be referred to as an antenna feed or antenna feed path, may include positive antenna feed terminal 94 and ground antenna feed terminal 96. If desired, antenna 40 may have multiple feeds. The configuration of FIG. 3 in which antenna 40 has a single feed is merely illustrative.

If desired, tunable components such as adjustable capacitors, adjustable inductors, filter circuitry, switches, impedance matching circuitry, duplexers, and other circuitry may be interposed within transmission line paths (i.e., between wireless circuitry 90 and feed 106). Tunable components may also be formed within the structures of antenna 40. For example, antenna resonating element structures 50 may include a tunable component such as tunable component LT in a return path (sometimes referred to as a short circuit branch or path) such as return path SC. Return path SC couples resonating element arm structures such as arms 100 and 102 of inverted-F antenna resonating element 50A to antenna ground 52. Tunable component LT may be an adjustable circuit such as a circuit including switching circuitry, inductor circuitry, and/or capacitor circuitry (as examples).

In the example of FIG. 3, tunable electrical component LT is an adjustable inductor that has a pair of terminals (terminals 110 and 112) that are coupled to the main arm of resonating element 50A and to antenna ground 52, respectively. Switch SW can be used to selectively switch short circuit path 114 or inductor 116 into use. Inductor 116 may have a fixed non-zero value (e.g., 24 mH as an example). When short circuit path 114 is switched into use (and inductor 116 is switched out of use), the impedance between terminals 110 and 112 will be 0 ohms (i.e., return path SC will form a short circuit. When short circuit path 114 is switched out of use and inductor 116 is switched into use, the impedance between terminals 110 and 112 will be 24 nH (in this example). Switch SW may also be placed in an open state in which both short circuit path 114 and inductor 116 are switched out of use (i.e., to cause return path SC to be an open circuit and thereby create an effectively infinite impedance between terminals 110 and 112). Depending on the type of impedance changes that are desired for a given antenna design, tunable element LT may alternate between a 0 ohm impedance state (short circuit operating mode) and a 24 nH impedance state (non-zero impedance operating mode) or may alternate between 0 ohms (short circuit state), 24 nH (non-zero impedance state), and infinite impedance (open circuit state). Other types of tunable inductor (e.g., with different numbers of operating modes) may be used, if desired.

Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Return path SC may be implemented using a strip of metal, a metal trace on a dielectric support structure such as a printed circuit or plastic carrier, or other conductive path that bridges gap 101 between resonating element arm structures (e.g., arms 102 and/or 100) and antenna ground 52. Tunable component LT may be implemented by a surface mount technology (SMT) device with terminals that are soldered within the metal of path SC, may be formed from multiple parts such as a packaged switch, a length of metal (for forming short circuit path 114), and an inductor (for forming inductor 116), or may be formed from other tunable circuitry imposed in return path SC.

Antenna feed 106 and its associated terminals 94 and 96 may be coupled in a path that bridges gap 101. The antenna feed formed from terminals 94 and 96 may, for example, be coupled in a path that bridges gap 101 in parallel with return path SC.

Resonating element arms 100 and 102 may form respective arms in a dual arm inverted-F antenna resonating element. Arms 100 and 102 may have one or more bends. The illustrative arrangement of FIG. 3 in which arms 100 and 102 run parallel to ground 52 is merely illustrative.

Arm 100 may be a (longer) low-band arm that handles lower frequencies, whereas arm 102 may be a (shorter) high-band arm that handles higher frequencies. Low-band arm 100 may allow antenna 40 to exhibit an antenna resonance at low band (LB) frequencies such as frequencies from 700 MHz to 960 MHz or other suitable frequencies. High-band arm 102 may allow antenna 40 to exhibit one or more antenna resonances at high band (HB) frequencies such as resonances at one or more ranges of frequencies between 960 MHz to 2700 MHz or other suitable frequencies.

Loop antenna element 50B may be formed from a loop of metal such as a strip of metal (e.g., stamped metal foil), metal traces on a flexible printed circuit (e.g., a printed circuit formed from a flexible substrate such as a layer of polyimide or a sheet of other polymer material), metal traces on a rigid printed circuit board substrate (e.g., a substrate formed from a layer of fiberglass-filled epoxy), metal traces on a plastic carrier, patterned metal on glass or ceramic support structures, wires, electronic device housing structures, metal parts of electrical components in device 10, or other conductive structures. The metal of loop antenna element 50B may, for example, form a metal strip with a circular shape or other elongated conductive line. One end of the metal strip or other elongated conductive member forming loop 50B may be connected to positive antenna feed terminal 94 and the opposing end of this conductive loop path may be connected to ground antenna feed terminal 96.

The presence of loop antenna resonating element 50B in antenna 40 may help expand the range of frequencies covered by a high-band resonance for antenna 40 or may otherwise enhance antenna performance. If desired, loop element 50B may be omitted and/or other types of antenna resonating elements for broadening the response of antenna resonances in antenna 40 may be used. The illustrative configuration of FIG. 3 in which antenna 40 includes inverted-F antenna resonating element 50A and loop antenna resonating element 50B is merely illustrative.

To provide antenna 40 with tuning capabilities, antenna 40 may include adjustable circuitry (e.g., tunable electrical component LT). The adjustable circuitry may be coupled between different locations on antenna resonating element 50, may be coupled between different locations on resonating element 50A, may be coupled between different locations on resonating element 50B, may form part of paths such as feed path 106 and return path SC that bridge gap 101, may form part of transmission line structures 92 (e.g., circuitry interposed within one or more of the conductive lines in path 92), or may be incorporated elsewhere in antenna structures 40, transmission line paths 92, and wireless circuitry 90.

The adjustable circuitry (e.g., tunable component LT) may be tuned using control signals from control circuitry 28 of FIG. 2 (e.g., a control signal applied to switch SW). Control signals from control circuitry 28 may, for example, be provided to an adjustable capacitor, adjustable inductor, or other adjustable circuit using a control signal path that is coupled between control circuitry 28 and the adjustable circuit (e.g., a path coupled to switch SW). Control circuitry 28 may provide control signals to adjust a capacitance exhibited by an adjustable capacitor, may provide control signals to adjust the inductance exhibited by an adjustable inductor, may provide control signals that adjust the impedance of a circuit that includes one or more components such fixed and variable capacitors, fixed and variable inductors, switching circuitry for switching electrical components such as capacitors and inductors, resistors, and other adjustable circuitry into and out of use, or may provide control signals to other adjustable circuitry for tuning the frequency response of antenna structures 40. As an example, antenna structures 40 may be provided with an adjustable inductor such as adjustable inductor LT of FIG. 3. By selecting a desired inductance value for adjustable inductor LT using control signals from control circuitry 28, antenna structures 40 can be tuned to cover operating frequencies of interest with desired antenna efficiencies.

FIG. 4 is a table showing illustrative inductance values that can be produced by adjustable inductor LT in response to control signals that are provided to switching circuitry SW of adjustable inductor LT to support operation in various communications bands. In the example of FIG. 4, an antenna of the type shown in FIG. 3 is being configured in three different ways to cover three different communications bands. When it is desired to use antenna 40 to cover high frequency communications band HB at frequencies of 1710-2170 MHz, inductor LT may be placed in a state in which short circuit line 114 is switched into use between terminals 110 and 112 (i.e., a 0 ohm operating mode for return path SC in which inductor LT forms a short circuit). When it is desired to use antenna 40 to cover a lower portion of low band LB from 700-790 MHz, inductor LT may be placed in a state in which short circuit path 114 and inductor 116 are both switched out of use (i.e., LT forms an open circuit for return path SC, so that the impedance of LT is effectively infinite). When it is desired to use antenna 40 to cover an upper portion of low band LB from 790-960 MHz, inductor LT may be placed in a state in which inductor 116 is switched into use. If, for example, inductor 116 has an inductance value of 24 nH, the inductance of inductor LT will be 24 nH. In this operating mode, return path SC will exhibit a non-zero inductance (e.g., 24 nH or other suitable value).

Figure 5:
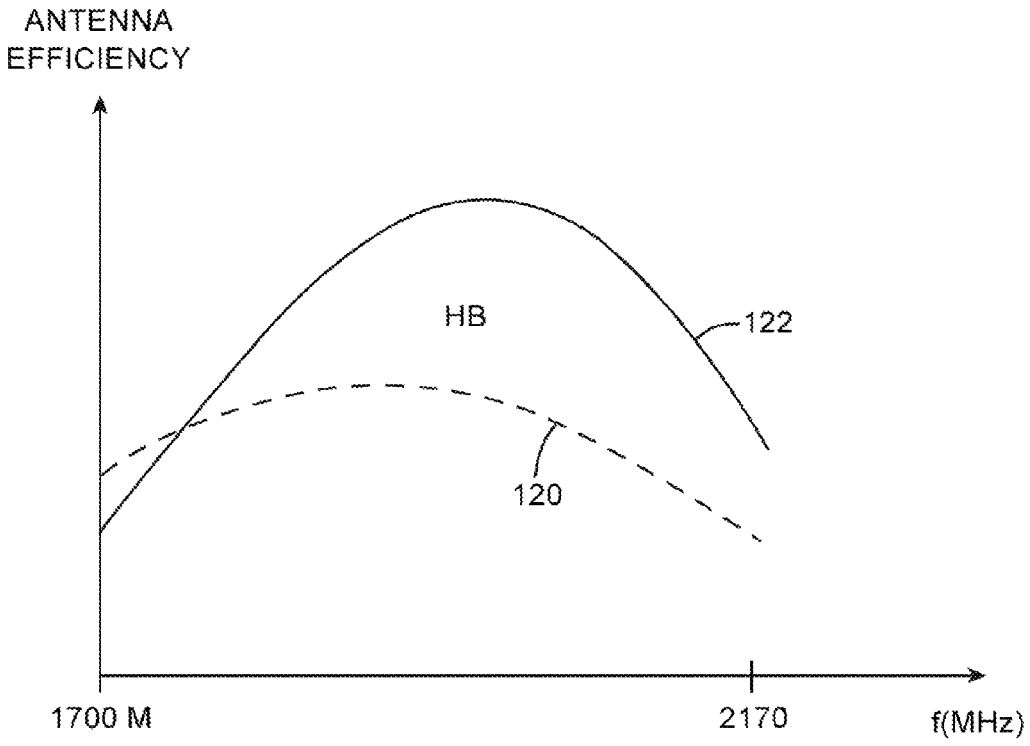
FIG. 5 is a graph in which antenna efficiency has been plotted as a function of operating frequency in a high frequency communications band for two different settings of an adjustable inductor in accordance with an embodiment of the present invention.

FIG. 5 is a graph in which antenna efficiency for antenna 40 of FIG. 3 has been plotted as a function of frequency f in high band HB. Dashed line 120 corresponds to the performance of antenna 40 when inductor LT has been configured to exhibit an inductance of 24 nH. Solid line 122 corresponds to the performance of antenna 40 when inductor LT has been configured to exhibit a short circuit impedance (i.e., when short circuit path 114 has been switched into use between terminals 110 and 112 while inductor 116 has been switched out of use). By shorting the main resonating element arm of inverted-F antenna resonating element 50A to antenna ground 52 via path 114 by configuring inductor LT in return path SC to exhibit a short circuit between terminals 110 and 112, antenna efficiency for antenna 40 in high band HB can be enhanced, as illustrated by comparing efficiency curve 122 to efficiency curve 120 in FIG. 5.

Figure 6:
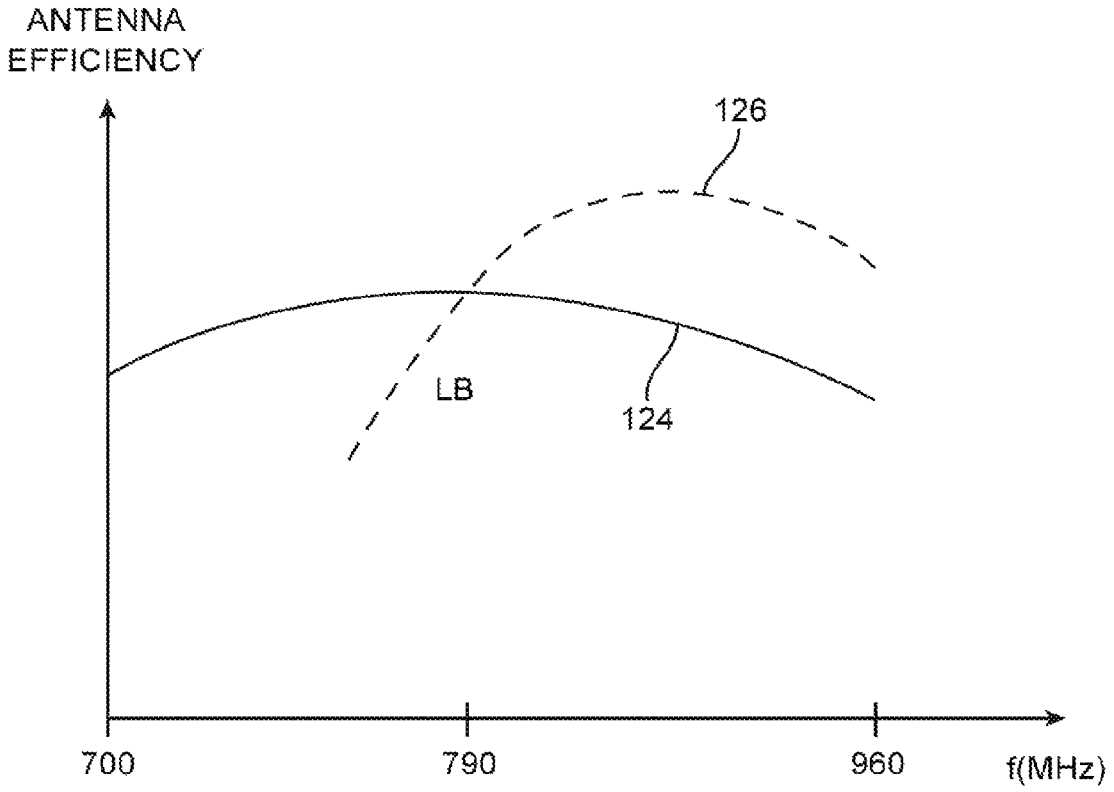
FIG. 6 is a graph in which antenna efficiency has been plotted as a function of operating frequency in a low frequency communications band for two different settings of an adjustable inductor in accordance with an embodiment of the present invention.

FIG. 6 is a graph in which antenna performance in low band LB has been plotted as a function of operating frequency for two different settings of adjustable inductor LT.

Solid line curve 124 corresponds to the performance of antenna 40 when inductor LT has been configured to form an open circuit between antenna resonating element 50A and antenna ground 52 (i.e., when switching circuitry SW is off, thereby switching both short circuit path 114 and inductor 116 out of use to place return path SC in an open circuit mode). By placing return path SC in an open circuit state in this way, antenna efficiency at the lower portion of low band LB (e.g., frequencies from 700 to 790 MHz) can be enhanced. When it is desired to operate antenna 40 in a higher portion of low band LB (e.g., frequencies from 790 MHz to 960 MHz), adjustable inductor LT in return path SC may be placed in a state in which short circuit path 114 is switched out of use and inductor 116 is switched into use. In this configuration, return path SC will exhibit a non-zero impedance of 24 nH due to the presence of inductor 116, and antenna efficiency will be enhanced at frequencies from 790 to 960 MHz, as illustrated by dashed line 126 of FIG. 6.

If desired, device 10 may be operated using two states for adjustable inductor LT. As shown in the table of FIG. 7, for example, inductor LT may be placed in a 0 ohms (short circuit) mode when it is desired for return path SC to form a short circuit. In this situation, antenna 40 may be used to handle high band (HB) signal frequencies from 1710 to 2690 MHz (as an example). When it is desired to operate antenna 40 from 790 to 960 MHz in low band LB, adjustable inductor LT may be placed in its 24 nH state by switching inductor 116 into use.

Figure 8:
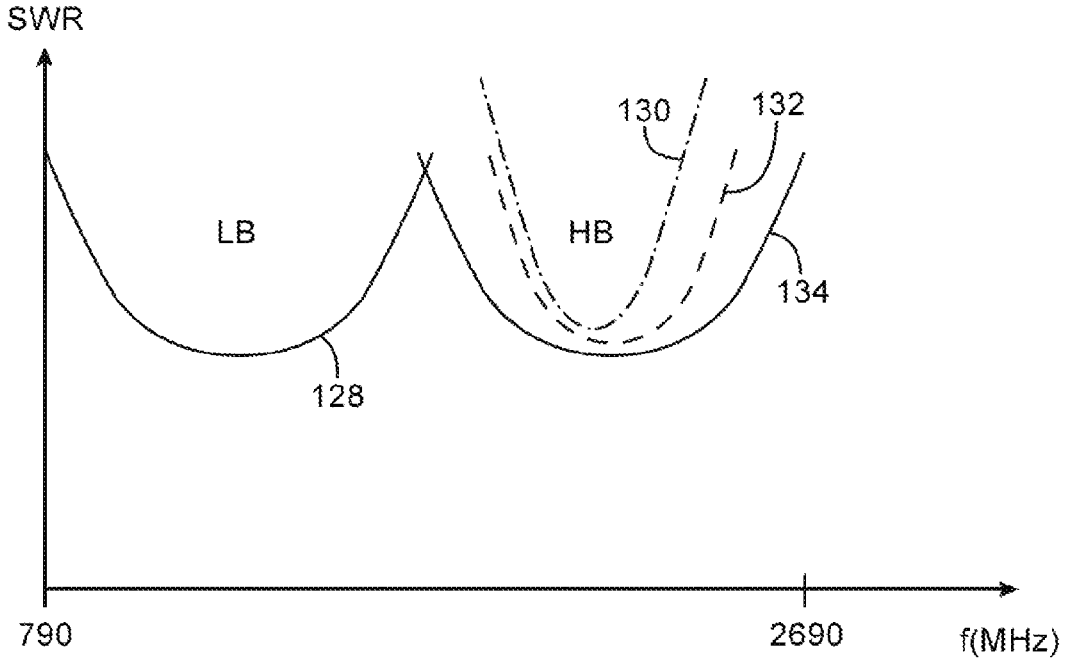
FIG. 8 is a graph in which antenna efficiency has been plotted as a function of operating frequency for antenna structures such as those using the settings of FIG. 7 in accordance with an embodiment of the present invention.

FIG. 8 is a graph in which antenna performance (standing wave ratio SWR) for an antenna such as antenna 40 of FIG. 3 has been plotted as a function of operating frequency. In the illustrative configuration of FIG. 8, antenna 40 has an adjustable inductor LT that is adjusted between the two states of FIG. 7. When it is desired to operate antenna 40 in low band LB, inductor LT is configured to exhibit a non-zero inductance of 24 nH (i.e., return path SC is configured to exhibit a non-zero inductance value). The antenna resonance that is exhibited by antenna 40 (e.g., low band arm 100 of resonating element 50A) is given by curve 128. When it is desired to operate antenna 40 in high band HB, inductor LT is configured to form a short circuit path (i.e., return path SC is configured as a short circuit).

The bandwidth of the high band antenna resonance for antenna 40 at band HB can be broadened by incorporating loop antenna structures into antenna 40. In the absence of loop antenna resonating element 50B, for example, antenna 40 may exhibit a relatively narrow high band resonance, of the type shown by dashed-and-dotted curve 130 of FIG. 8. By incorporating loop antenna resonating element 50B into antenna 40, the bandwidth of the high band resonance may be expanded (i.e., loop antenna resonating element 50B may contribute an additional response to the high band resonance). The resulting widened high band antenna resonance for antenna 40 in the presence of loop element 50B is given by dashed line 132 in the example of FIG. 8.

Further broadening of the bandwidth of the high band antenna resonance for antenna 40 may be achieved by incorporating an additional ground plane structure such as ground plane portion 52' of ground plane 52 of FIG. 3 into antenna 40. Portion 52' of the antenna ground of FIG. 3 may overlap some or all of loop antenna resonating element 50B, as shown in FIG. 3. There is preferably a non-zero separation LZ in dimension Z (into the page in the orientation of FIG. 3) between antenna ground 52' and loop antenna resonating element 50B. Air, plastic, or other dielectric can be formed in the gap between ground 52' and overlapping loop antenna resonating element 50B. The additional broadening of the high band antenna resonance that is achieved by incorporating antenna ground portion 52' into antenna 40 of FIG. 3 is illustrated by curve 134 of FIG. 8. This type of high band bandwidth broadening scheme may be used in antenna 40 in a configuration in which element LT is switched between two states, in a configuration in which element LT is switched between three states, or another antenna configurations.

The foregoing is merely illustrative of the principles of this invention and various modifications can be made by those skilled in the art without departing from the scope and spirit of the invention.

What is claimed is:

1. Electronic device antenna structures, comprising:

an antenna ground;

a first antenna resonating element;

an antenna feed coupled between the antenna ground and the first antenna resonating element, wherein the antenna feed has a positive antenna feed terminal and a ground antenna feed terminal; and a second antenna resonating element interposed between the first antenna resonating element and the antenna ground that has a first end coupled to the positive antenna feed terminal and a second end coupled to the ground antenna feed terminal, wherein the first antenna resonating element comprises an inverted-F antenna resonating element, the second antenna resonating element comprises a loop antenna resonating element, a portion of the loop antenna resonating element overlaps a portion of the antenna ground, the first antenna resonating element comprises a portion of a peripheral conductive electronic device housing member that is formed at an exterior of an electronic device, and the portion of the peripheral conductive electronic device housing member is separated from the antenna ground by a first dielectric gap having a first length and is separated from the portion of the antenna ground that overlaps the portion of the loop antenna resonating element by a second gap having a second length that is less than the first length.

2. The electronic device antenna structures defined in claim 1 wherein the inverted-F antenna resonating element comprises a portion of a peripheral conductive electronic device housing member.

3. The electronic device antenna structures defined in claim 2 further comprising a return path coupled between the first antenna resonating element and the antenna ground in parallel with the antenna feed.

4. The electronic device antenna structures defined in claim 3 wherein the return path includes an adjustable electrical component.

5. The electronic device antenna structures defined in claim 4 wherein the adjustable electrical component comprises an adjustable inductor.

6. The electronic device antenna structures defined in claim 5 wherein the adjustable inductor includes switching circuitry, a short circuit path, and a fixed inductor and wherein the switching circuitry is configured to selectively switch the short circuit path and the fixed inductor into use in the return path.

7. The electronic device antenna structures defined in claim 6 wherein the switching circuitry is further configured to simultaneously switch the short circuit path and the fixed inductor out of use to place the return path in an open circuit state.

8. The electronic device antenna structures defined in claim 2, wherein the portion of the peripheral conductive electronic device housing member comprises at least one external surface of an electronic device and the antenna ground is separated from the portion of the peripheral conductive electronic device housing member by a gap.

9. The electronic device antenna structures defined in claim 8, wherein the portion of the peripheral conductive electronic device housing member forms at three different external surfaces of the electronic device.

10. The electronic device antenna structures defined in claim 1 further comprising a return path coupled between the first antenna resonating element and the antenna ground in parallel with the antenna feed, wherein the return path is selectively placed in at least two different states including a short circuit state and a non-zero inductance state.

11. The electronic device antenna structures defined in claim 10 further comprising an adjustable circuit in the return path that places the return path in the short circuit state and the non-zero inductance state, wherein the adjustable circuit is operable to place the return path in an open circuit state.

12. The electronic device antenna structures defined in claim 1, wherein a first end of the loop antenna resonating element is electrically connected to the positive antenna feed terminal and a second end of the loop antenna resonating element is electrically connected to the negative antenna feed terminal.

13. The electronic device antenna structures defined in claim 12, wherein the loop antenna resonating element comprises a strip of metal.

14. The electronic device antenna structures defined in claim 1, wherein the inverted-F antenna resonating element has a first arm that is configured to resonate in high band frequency range and a second arm that is configured to resonate in a low band frequency range, the first arm extends from a first side of the positive antenna feed terminal and in a given plane, the second arm extends from a second side of the positive antenna feed terminal and in the given plane, and the loop antenna resonating element extends from the first side of the positive antenna feed terminal.

15. Electronic device antenna structures, comprising:

an antenna ground;

an inverted-F antenna resonating element having a first arm that is configured to resonate in high band frequency range and a second arm that is configured to resonate in a low band frequency range;

an antenna feed coupled between the antenna ground and the inverted-F antenna resonating element, wherein the antenna feed has a positive antenna feed terminal and a ground antenna feed terminal, the first arm extends from a first side of the positive antenna feed terminal and in a given plane, and the second arm extends from a second side of the positive antenna feed terminal and in the given plane; and a loop antenna resonating element interposed between the inverted-F antenna resonating element and the antenna ground that has a first end coupled to the positive antenna feed terminal and a second end coupled to the ground antenna feed terminal, wherein the loop antenna resonating element extends from the first side of the positive antenna feed terminal, an entirety of the loop antenna resonating element extends along the first side of the positive antenna feed terminal, and the loop antenna resonating element is configured to broaden the high band frequency range in which the first arm resonates.

16. Electronic device antenna structures, comprising:

an antenna ground;

a first antenna resonating element;

an antenna feed coupled between the antenna ground and the first antenna resonating element, wherein the antenna feed has a positive antenna feed terminal and a ground antenna feed terminal; and a second antenna resonating element that has a first end coupled to the positive antenna feed terminal and a second end coupled to the ground antenna feed terminal, wherein the first antenna resonating element has a first arm configured to resonate in a low band frequency range and a second arm configured to resonate in a high band frequency range, and the second antenna resonating element is configured to broaden the high band frequency range in which the second arm of the first antenna resonating element resonates.

* * * * *